United States Patent [19]

Franz

[11] 4,098,619

[45] Jul. 4, 1978

[54] ARCHITECTURAL ALUMINUM ALLOY SHEET AND METHOD THEREFOR

[75] Inventor: Edmund C. Franz, Pittsburgh, Pa.

[73] Assignee: Aluminum Company of America, Pittsburgh, Pa.

[21] Appl. No.: 657,444

[22] Filed: Feb. 12, 1976

[51] Int. Cl.[2] ..... C22F 1/04

[52] U.S. Cl. ..... 148/2; 75/148; 148/11.5 A; 148/31.5; 148/32; 204/29; 204/58

[58] Field of Search ..... 148/11.5 A, 31.5, 32, 148/2; 204/29, 58; 75/148

[56] References Cited

U.S. PATENT DOCUMENTS

| | | | |
|---|---|---|---|
| 2,262,696 | 11/1941 | Nock et al. | 148/11.5 A |
| 3,475,167 | 10/1969 | Beatty et al. | 204/58 |

*Primary Examiner*—R. Dean

*Attorney, Agent, or Firm*—Andrew Alexander

[57] ABSTRACT

An improved aluminum alloy, temper insensitive to color anodizing, consists essentially of, by weight, 0.40–0.60% Si, 0.20–0.40% Fe, 0.30–0.60% Mn, the balance essentially aluminum and incidental elements and impurities in an amount insufficient to render the alloy temper sensitive to anodizing.

4 Claims, No Drawings

ARCHITECTURAL ALUMINUM ALLOY SHEET AND METHOD THEREFOR

INTRODUCTION

This invention relates to an aluminum architectural alloy and more particularly to an aluminum architectural alloy suitable for color anodizing.

Because of the wide use of aluminum alloys in architectural applications, considerable effort is spent developing new aluminum alloys having very specific properties which eliminate specific problems and make the use of aluminum alloys in the architectural field even more lucrative. With respect to color anodizing aluminum, one long standing problem encountered in the architectural field is obtaining uniform color on all panels on a building. Often, aluminum panels, even those produced from the same starting stock and anodized under the same conditions, can vary slightly in color resulting in the appearance of the building being aesthetically unattractive. Thus, in an attempt to ensure color match or agreement on a building, anodized panels are often required to fall within a certain color range. Panels failing to fall within the color range are rejected which can result in their being scrapped or in some cases stripped of the anodized coating and re-anodized to make the color conform to the color range, if possible. Obviously, scrapping or re-anodizing the panels interferes with production schedules and thus is highly undesirable. One factor which can lead to these often undesirable variations in the anodized color, is the alloy temper which, if it varies even slightly from a specified temper can, in many instances, provide different colors in the same alloy. It should be noted that temper variation is often used to provide different colors. Thus, if all the batches of sheet, for example, are not fabricated to the identical temper, this is often reflected in anodizing by having great difficulty in bringing the color within the color range or specification. Thus, because of these difficulties with color match, it is highly desirable to minimize the effect of temper in certain alloys in order to reduce color variation.

The present invention, therefore, minimizes the problem of color match by providing an aluminum base alloy, the color anodizing of which is not affected by the temper of the alloy.

SUMMARY OF THE INVENTION

An improved aluminum base alloy suitable for architectural application is provided, the color anodizing of which is unaffected or insensitive to alloy temper. The alloy consists essentially of, by weight, 0.40–0.60% Si, 0.20–0.40% Fe, 0.40–0.60% Mn, the balance essentially aluminum and incidental elements and impurities in an amount insufficient to render color anodizing temper sensitive.

OBJECTS

An object of the present invention is to provide an improved aluminum architectural alloy.

Another object of the present invention is to provide an aluminum architectural alloy suitable for anodizing.

Yet another object of the present invention is to provide an aluminum architectural alloy the color anodizing of which is temper insensitive.

DETAILED DESCRIPTION OF THE PREFERRED EMBODIMENTS

In accordance with the present invention, an aluminum base alloy suitable for architectural applications is provided. The alloy can be anodized by conventional methods to a suitable color and color development thereon, as noted, is insensitive to alloy temper. That is, the alloy can be provided in sheet form, for example, in any number of tempers and the color development or response thereon using similar anodizing conditions, especially using anodizing baths or cells employing the combination organic and inorganic acids, is virtually unaffected by the temper. The combination of organic and inorganic acids referred to include the sulfo-organic/inorganic acid electrolyte, for example, sulfophthalic/sulfuric acid or the like. Such type electrolyte is disclosed in Kampert U.S. Patent 3,227,639, incorporated herein by reference. In addition, the alloy, in sheet or other form, may be anodized by using a sulfuric acid electrolyte well known to those skilled in the art.

To obtain these unique properties the composition of the alloy should be controlled within rather precise limits. Thus, in its broadest aspect, the composition of the alloy consists essentially of, by weight, 0.30–0.60% silicon, 0.20–0.40% iron, 0.30–0.60% manganese, the remainder essentially aluminum and elements and impurities in an amount insufficient to render the alloy temper sensitive to color anodizing. That is, impurities and other elements should be kept to a level sufficiently low that any of the tempers commonly associated with an alloy of this class can be anodized under similar anodizing conditions without producing a change in the color obtained. Thus, impurities should be carefully controlled within the following upper limit: 0.05% copper, 0.05% chromium, 0.05% zinc, 0.10% titanium and 0.10% magnesium. All other impurities are preferably limited to about 0.05% each and the combination of other impurities should not exceed 0.15%. Within these limits it is preferred that the sum total of all impurities does not exceed 0.40%. As noted above, magnesium can, in certain cases, be tolerated up to 0.10%; however, preferably magnesium should be kept to not more than 0.05%.

The alloy may be suitably provided in ingot form by techniques currently employed in the art. These include continuously or otherwise casting an ingot and further preparing such for rolling into sheet, for example, by preliminary scalping, and the like. When it is desired to fabricate sheet, the ingot is preheated to a temperature in the range of 950° to 1125° F for a period of 4 to 24 hours with a temperature of 1100° to 1125° F and a period of about 4 hours being preferred. Thereafter, the ingot can be cold rolled or conveniently hot rolled at 750° to 850° F, preferably 780° to 825° F, to a thickness suitable for architectural application.

The strength of this alloy is not especially striking. Rolled sheet typically exhibits tensile property levels of 15 to 35 ksi. This strength level can be adequate for architectural applications such as curtain walls for large buildings. However, the alloy of this invention can be laminated or clad to a core alloy such as 3003 or the like (as taught, for example, in Brown U.S. Pat. No. 1,997,166 incorporated herein by reference) to provide higher strengths and to provide a more uniform metallurgical structure which is more responsive to uniform color development. That is, upon laminating the alloy of the present invention to a core material selected for some special property, e.g. strength, the composite can be subjected to thermal or working practices to obtain these special properties in the core without affecting uniformity of color upon anodizing. This characteristic of the subject alloy is very significant since, as has been pointed out, many prior alloys are sensitive to even slight changes or variations in fabricating practices with respect to color development on anodizing and, as noted, such variation can lead to rejection of the sheet. The cladding referred to has a typical thickness of about 0.006 to 0.03 inches on a core of about 0.09–0.25 inches thick. Typically, the cladding material is about 7–15% of the total composite.

With respect to the metallurgical structure of the alloy in the unclad condition, insoluble constituents therein can be coarser and less uniformly distributed than that in the clad condition. In the clad condition, as noted, the insoluble constituents are relatively fine and uniformly distributed and as a result problems such as structural streaking of the anodized color are minimized.

The subject alloy, provided in sheet form, anodized and sealed in accordance with processes well known to those skilled in the art has a high resistance to corrosive environments. Thus, it will be noted that even though the alloy provides the advantage of being temper insensitive to color anodizing, the quality of the anodized finish is not affected.

The various tempers in which the present alloy can be provided and which are insensitive to anodizing are those well known in the aluminum industry. They include the tempers tabulated below with their typical thermal treatments or fabrication steps.

Table I

| Temper | Thermal and Processing Practices After Preheating to 1100° F and Hot Rolling at 800° F to 0.125" Thick Sheet<br>Treatment |
|---|---|
| H112 | No additional treatment |
| 0 | Anneal 2 hrs. at 775° F |
| H111 | Anneal 2 hrs. at 775° F, cold roll 1%, stretch 5% |
| H12 | Anneal 2 hrs. at 775° F, cold roll to 0.100" thick |
| H14 | Anneal 2 hrs. at 775° F, cold roll to 0.080" thick |
| H25 | Cold roll to 0.080", partially anneal 6 hrs. at 475° F |
| H18 | Anneal 2 hrs. at 775° F, cold roll to 0.064", stretch 1% |
| H341 | Anneal 2 hrs. at 775° F, cold roll to 0.064", stretch 1% partially anneal 6 hrs. at 300° F |

The sheet of the present alloy can be produced in accordance with any of the procedures outlined in Table 1 without fear of affecting the color response to a given set of anodizing conditions. In addition, as mentioned earlier, if the present alloy is applied as a cladding on a higher strength core alloy, the composite can be treated to develop the properties of the core without affecting color response to anodizing. It will be appreciated that this feature alone is a significant advantage.

The color of the integrally colored anodic coating obtained on sheet, for example, of the present alloy can be described by reference to its Munsell value which is a recognized system of color description described in ASTM Designation: 1) 1536-68; ASTM STANDARDS PART II 1969 p. 285.

The Munsell value is described in terms of hue, value and chroma. Thus, with respect to the color range referred to hereinabove to which integrally colored anodized panels are required to conform to provide a pleasing appearance on a building, this color range can be described in terms of Munsell values. For example, a light gray color produced on sheet of the present alloy by anodizing (as described in Example 1) should have a color whose hue would be in the range of 4GY to 7B, value would be in the range of 4.7 to 5.2 and chroma is less than /0.20 in order to provide a commercially acceptable color match. To provide a dark gray color by anodizing sheet of the subject invention (as described in Example 2), the hue would be in the range of 4.5YR to 8.0YR, value, 2.5 to 2.9 and chroma, less than /0.20. Thus, for these particular light and dark gray colors, Munsell measurements falling outside these respective ranges would be expected to provide an unsatisfactory color match.

The following examples are still further illustrative of the invention.

EXAMPLE 1

An alloy in accordance with the invention consisting of 0.33% Si, 0.28% Fe, 0.42% Mn, 0.01% Cu, 0.02% Mg, 0.02% Zn and 0.02% Ti, the remainder aluminum was produced by continuous casting into ingot suitable for rolling into sheet. The ingot was homogenized by heating to 1100° F for 4 hours and thereafter allowed to cool to about 820° F and then rolled to a thickness of 0.125 inch. The sheet was cut into sections which were fabricated into tempers tabulated in Table 1. These various tempers were anodized to a light gray color in an aqueous bath containing 90–100 grams/liter of sulfophthalic acid and 5.5–6.0 grams/liter of sulfuric acid at about 95° F using a current density of about 10 amperes per square foot for 60 minutes. Visual inspection did not discern any differences in the light gray color obtained among the various tempers. The specimens were then rated according to their Munsell value, the results of which are tabulated below.

Table II

| Temper | Hue | Munsell Value<br>Value | Chroma |
|---|---|---|---|
| H112 | 5GY | 5.05 | .04 |
| 0 | 7B | 5.14 | .10 |
| H111 | 5B | 4.95 | .14 |
| H12 | 6.5B | 5.10 | .11 |
| H14 | 6.8B | 5.01 | .08 |
| H25 | 4GY | 4.74 | .06 |
| H18 | 7B | 4.81 | .10 |
| H341 | 5B | 4.92 | .13 |

EXAMPLE 2

Specimens were prepared as in Example 1 except the current density was 18 amperes per square foot for 50 minutes at a temperature of 90° F to provide a dark gray color. Visual inspection of the specimen did not discern a color difference from one temper to another. Rating the colors by Munsell value gave the following readings:

Table III

| Temper | Hue | Munsell Value<br>Value | Chroma |
|---|---|---|---|
| H112 | 5YR | 2.81 | .05 |
| 0 | 5YR | 2.74 | .08 |
| H111 | 5YR | 2.66 | .13 |
| H12 | 5YR | 2.65 | .13 |
| H14 | 5YR | 2.70 | .14 |
| H25 | 7.5YR | 2.64 | .10 |
| H18 | 5YR | 2.69 | .10 |

Table III-continued

| Temper | Hue | Munsell Value Value | Chroma |
|---|---|---|---|
| H341 | 7.5YR | 2.73 | .13 |

EXAMPLE 3

An alloy slab of about 1.2 inches thick having a composition as in Example 1 was clad on both sides of a core of Aluminum Association Alloy 3003 to provide a composite of about 12 inches thick. Thereafter, the composite was heated for 21 hours at 950° F and then rolled at about 860° F to a 6 inches thickness. After reheating the 6 inches composite for 2 hours at 800° F, it was then rolled to a thickness of 0.188 inches at a temperature of about 690° F. Specimens of this product were anodized to light and dark gray colors substantially as indicated in Examples 1 and 2, respectively. Also, specimens were anodized in the electrolyte of Example 1 to a medium gray using a current density of 12 amps/ft.$^2$ at a temperature of 85° F for a time of 50 minutes. In addition, a black anodized coating was provided on this composite sheet in the electrolyte of Example 1 using 24 amps/ft.$^2$ at a temperature of 70° F for a total time of 45 minutes.

Thus, it can be seen from the results in Examples 1 and 2 that this alloy can be subjected to various anodizing conditions to provide different colors, such as light to dark gray. Yet, while using the same anodizing conditions at different alloy tempers, the color obtained thereon does not vary substantially with a change in temper.

While the invention has been described in terms of preferred embodiments, the claims appended hereto are intended to encompass all embodiments which fall within the spirit of the invention.

Having thus described my invention and certain embodiments thereof, I claim:

1. In the production of an improved aluminum alloy sheet, the steps comprising:

(a) providing a body of an aluminum base alloy consisting essentially of, by weight, 0.40 to 0.60% Si, 0.20 to 0.40% Fe, 0.30 to 0.60% Mn, the balance essentially aluminum and incidental elements and impurities in an amount insufficient to render said alloy temper sensitive to anodizing;

(b) heating said body for a period of 4 to 24 hours at a temperature in the range of 950° to 1125° F;

(c) rolling said body to said sheet at a temperature in the range of 750° to 850° F; and (d) anodizing said sheet in an electrolyte of organic and inorganic acids, the sheet characterized by being temper insensitive to said anodizing.

2. The method according to claim 1 wherein the amount of said impurities is not greater than 0.40.

3. The method according to claim 1 wherein the color developed on said sheet by said anodizing ranges from light to very dark gray.

4. An improved aluminum alloy sheet product the color anodizing thereof in an electrolyte of organic and inorganic acids characterized by being temper insensitive to said anodizing, said product comprising an aluminum base alloy consisting essentially of, by weight, 0.40 to 0.60% Si, 0.20 to 0.40% Fe, 0.30 to 0.60% Mn, the balance essentially aluminum and incidental elements and impurities in an amount insufficient to render said alloy temper sensitive to said anodizing, the alloy sheet product provided by heating a body of said alloy for a period of 4 to 24 hours at a temperature in the range of 950° to 1125° F and, thereafter, by rolling said body to said sheet at a temperature in the range of 750° to 850° F.

* * * * *